US010015578B2

(12) United States Patent
Freitas

(10) Patent No.: US 10,015,578 B2
(45) Date of Patent: Jul. 3, 2018

(54) REMOTE GROUND SENSING FOR REDUCED CROSSTALK OF HEADSET AND MICROPHONE AUDIO SIGNALS

(71) Applicant: Fairchild Semiconductor Corporation, San Jose, CA (US)

(72) Inventor: Oscar W. Freitas, Cape Elizabeth, ME (US)

(73) Assignee: Fairchild Semiconductor Corporation, San Jose, CA (US)

( * ) Notice: Subject to any disclaimer, the term of this patent is extended or adjusted under 35 U.S.C. 154(b) by 100 days.

(21) Appl. No.: 14/944,702

(22) Filed: Nov. 18, 2015

(65) Prior Publication Data

US 2016/0142810 A1 May 19, 2016

Related U.S. Application Data

(60) Provisional application No. 62/081,835, filed on Nov. 19, 2014.

(51) Int. Cl.
*H04R 1/10* (2006.01)
*H04R 29/00* (2006.01)

(52) U.S. Cl.
CPC ..... *H04R 1/1041* (2013.01); *H04R 29/004* (2013.01); *H04R 2410/03* (2013.01); *H04R 2420/05* (2013.01); *H04R 2420/09* (2013.01)

(58) Field of Classification Search
CPC ..... H04R 1/1041; H04R 29/004; H04R 2410/03; H04R 2420/05; H04R 2420/09
USPC ..... 381/74, 80, 81, 91, 111, 122, 123, 309
See application file for complete search history.

(56) References Cited

U.S. PATENT DOCUMENTS 5,509,078 A 4/1996 Hiraoka et al.
5,537,668 A 7/1996 Nambu et al.
7,925,030 B2 * 4/2011 Holmstrom ..... H04S 1/00 381/1
8,130,972 B2 3/2012 Suzuki
(Continued)

FOREIGN PATENT DOCUMENTS

CN 1813400 A 8/2006
CN 101159995 A 4/2008
(Continued)

OTHER PUBLICATIONS

"U.S. Appl. No. 14/928,157, Non Final Office Action dated Dec. 27, 2016", 22 pgs.

(Continued)

*Primary Examiner* — William A Jerez Lora
(74) *Attorney, Agent, or Firm* — Brake Hughes Bellermann LLP

(57) ABSTRACT

Apparatus and methods for reducing crosstalk in personal audio equipment are provided. In an example, a method to reduce headset audio crosstalk can include applying a first signal to a first speaker channel of a headset, coupling a second speaker channel to a first input of a comparator of a crosstalk compensation circuit using a first switch of the crosstalk compensation circuit, the switch and detect circuit including the crosstalk compensation circuit, coupling a first resistor divider to a second input of the comparator using a second switch of the crosstalk compensation circuit, and adjusting a resistance setting of the first resistor divider from an initial setting using an output of the comparator.

22 Claims, 4 Drawing Sheets

(56) References Cited

U.S. PATENT DOCUMENTS

| | | | | |
|---|---|---|---|---|
| 8,831,230 | B2 | 9/2014 | Llewellyn et al. | |
| 2001/0049813 | A1 | 12/2001 | Chan et al. | |
| 2002/0137506 | A1* | 9/2002 | Matsuoka | H04R 29/001 455/425 |
| 2002/0164042 | A1 | 11/2002 | Vonlanthen | |
| 2008/0085010 | A1 | 4/2008 | Suzuki | |
| 2012/0092802 | A1* | 4/2012 | Weiher | H02H 3/093 361/96 |
| 2012/0262230 | A1* | 10/2012 | Llewellyn | H03F 3/187 330/2 |
| 2013/0156238 | A1 | 6/2013 | Birch et al. | |
| 2013/0194115 | A1* | 8/2013 | Wu | H03M 1/144 341/110 |
| 2013/0309996 | A1* | 11/2013 | Siegel | H04M 1/6058 455/405 |
| 2015/0098579 | A1 | 4/2015 | Holzmann | |
| 2015/0304769 | A1* | 10/2015 | Weijand | H04R 1/1041 381/123 |
| 2016/0127828 | A1 | 5/2016 | Maher et al. | |

FOREIGN PATENT DOCUMENTS

| | | | |
|---|---|---|---|
| CN | 101491117 | A | 7/2009 |
| CN | 102739176 | A | 10/2012 |
| CN | 202663530 | U | 1/2013 |
| CN | 105611459 | A | 5/2016 |
| KR | 1020160059992 | A | 5/2016 |

OTHER PUBLICATIONS

U.S. Appl. No. 13/272,021, now U.S. Pat No. 8,831,230, filed Oct. 12, 2011, Amplifier Crosstalk Cancellation Technique.

U.S. Appl. No. 14/928,157, filed Oct. 30, 2015, Audio Crosstalk Calibration Switch.

"U.S. Appl. No. 13/272,021, Non Final Office Action dated Jan. 29, 2014", 10 pgs.

"U.S. Appl. No. 13/272,021, Notice of Allowance dated Jun. 16, 2014", 8 pgs.

"U.S. Appl. No. 13/272,021, Response filed May 29, 2014 to Non Final Office Action dated Jan. 29, 2014", 9 pgs.

"U.S. Appl. No. 14/928,157, Preliminary Amendment filed Oct. 30, 2015", 7 pgs.

"Chinese Application Serial No. 201210111398,7, Office Action dated Aug. 5, 2014", w/English Translation, 8 pgs.

"Chinese Application Serial No. 201220159022.9, Voluntary Amendment filed May 2, 2012", w/ English Translation, 3 pgs.

* cited by examiner

REMOTE GROUND SENSING FOR REDUCED CROSSTALK OF HEADSET AND MICROPHONE AUDIO SIGNALS

PRIORITY AND RELATED APPLICATIONS

This application claims the benefit of priority to U.S. Provisional Patent Application Ser. No. 62/081,835 filed on Nov. 19, 2014, titled, "REMOTE GROUND SENSING FOR REDUCED CROSSTALK OF HEADSET MICROPHONE AND AUDIO SIGNALS," which is incorporated by reference herein in its entirety.

OVERVIEW

Apparatus and methods for reducing crosstalk in personal audio equipment are provided. In an example, a method to reduce headset audio crosstalk can include applying a first signal to a first speaker channel of a headset, coupling a second speaker channel to a first input of a comparator of a crosstalk compensation circuit using a first switch of the crosstalk compensation circuit, the switch and detect circuit including the crosstalk compensation circuit, coupling a first resistor divider to a second input of the comparator using a second switch of the crosstalk compensation circuit, and adjusting a resistance setting of the first resistor divider from an initial setting using an output of the comparator.

This overview is intended to provide a partial summary of the subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
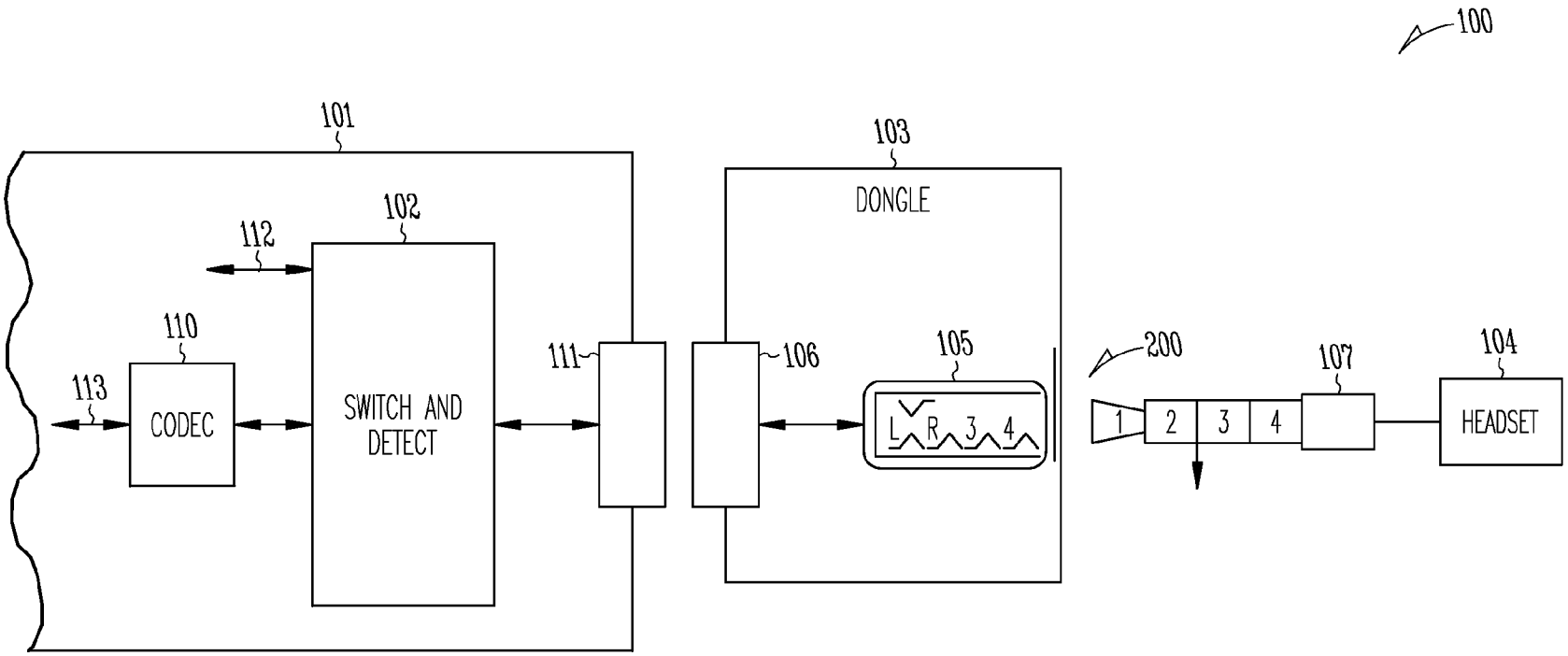
FIG. 1 illustrates generally an example system that includes an audio dongle that is consistent with the USB-C specification and includes an audio jack.

FIG. 1 illustrates generally an example system 100 that includes an electronic device 101, an audio dongle 103, and a headset 104. In certain examples, the electronic device can include an audio coder/decoder (CODEC) 110, an example switch and detection circuit 102 and a Universal Serial Bus (USB) connector 111. In certain examples, the audio dongle can include a 3 or 4 contact audio jack connector 105 such as an audio jack receptacle in addition to one or more USB connectors 106. In some examples, the USB connector 106 can be consistent with the USB-type C (USB-C) specification and can mate with the USB connector 111 of the electronic device. In certain examples, the headset 104 can be an OMTP (European) or a CTIA (US) type headset and can include at least one speaker. In some examples, the headset 104 can include two speakers such as a right speaker and a left speaker. In some examples, the headset 104 can include a microphone. In certain examples, the headset 104 can include an audio jack connector 107, such as an audio jack plug. In some examples, the reversibility of the USB-C connector can include switching that is the same as or closely resembles the SBU1/SBU2 switching for the reversibility of the microphone (MIC) and ground (AGND) signal for OMTP (European) and CTIA (US) type headsets. This functionality can place switches in the ground path. In certain situations, headset ground may be separated from USB-C connector ground because of charging currents. Since the actual ground can be in the headset where the microphone and the left and right speakers meet, such a ground can be considerably different from the ground after a switch that handles the reversibility of the connectors 105, 107, 106, 111 and MIC/AGND switching. In certain applications, the USB connector 106, 111 can be some distance from the audio CODEC 110 that drives the audio signals or receives the microphone input, thus, the distance can have the potential to cause further ground differences. In certain applications, the performance specifications for audio dongle 103 including type-C USB connectors can be difficult to meet without more information about the ground differences between the headset 104 and the electronic device 101 coupled in the system. Sensing after the USB connector 106 can help but may not account for all the ground drop in the audio dongle 103, USB plug 111 or audio jack connector 105.

The present inventors have recognized, among other things, circuits and methods of an electronic device that can sense remote ground upon first connection of an audio device or accessory to an audio device, such as an headphone or headset, can store values indicative of the sensed remote ground for each audio channel, and can minimize crosstalk between channels during normal operation using the stored values. In some examples, a compensation mode or modes can be executed upon first detecting connection of an accessory. In certain examples, the audio device can use a standardized connection and/or connection protocol to connect with the audio source device (e.g., USB Type-C (USB-C), etc.) In some examples, crosstalk contribution or noise as seen by a microphone signal of the audio device or accessory can be detected and can be used to provide additional crosstalk cancellation or compensation of the microphone line. In certain examples, a circuit according to the present subject matter can provide an internal microphone bias to allow further crosstalk cancellation of the microphone line during an initial attach by detecting the contribution of crosstalk as seen by the microphone signal.

Figure 2A:
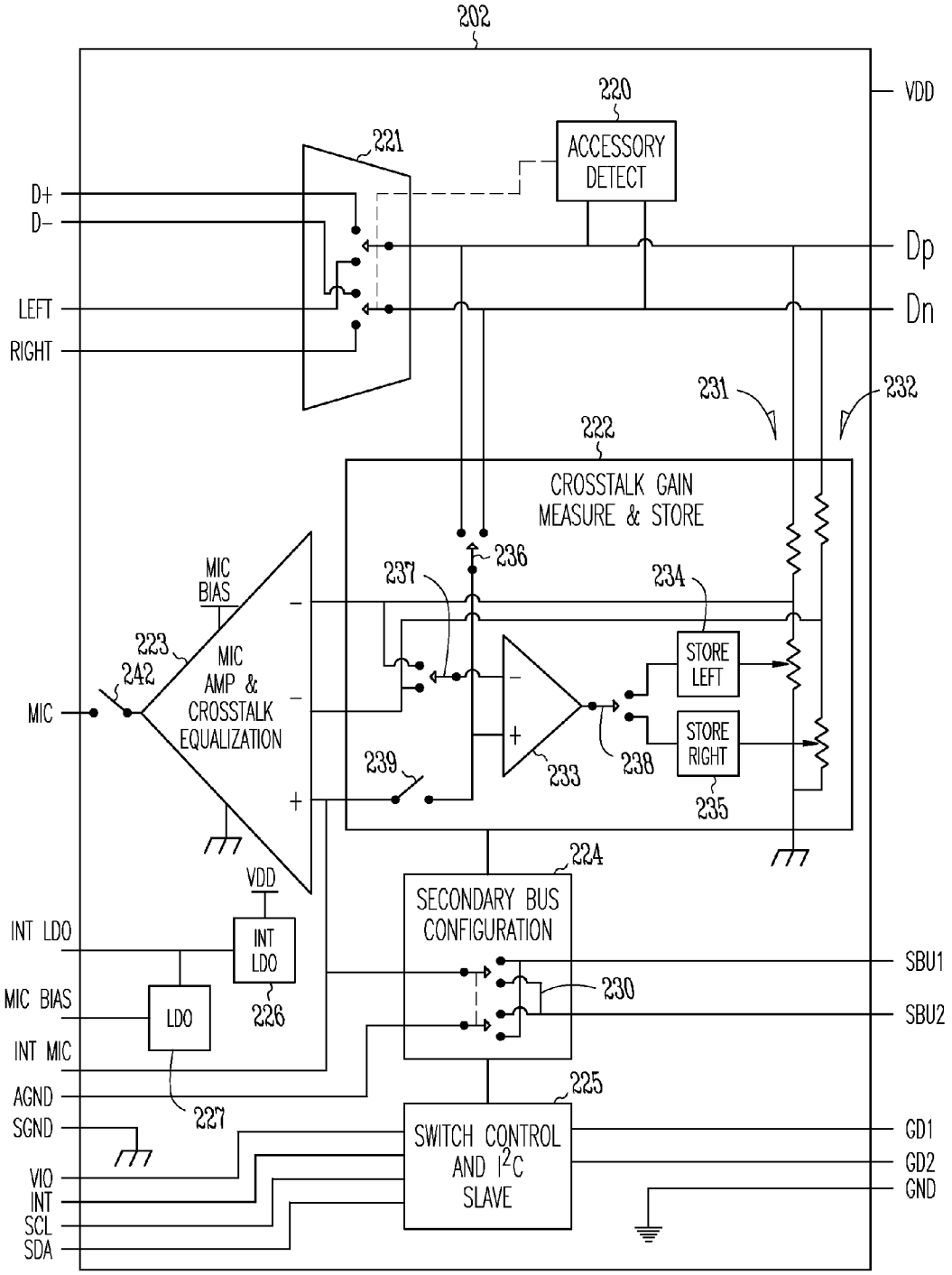
FIG. 2A illustrates generally an example detection circuit

FIG. 2A illustrates generally an example switch and detection circuit 202 that can include an accessory detection circuit 220, a multiplexer 221, a crosstalk gain measure and store circuit 222, and a microphone amplifier and equalization circuit 223. In some examples, the switch and detection circuit 202 can include a secondary bus switch circuit 224. In some examples, the switch and detection circuit 202 can include an I2C slave circuit and a switch controller 225. In some examples, the controller can be separate from the I2C slave circuit. In certain examples, the controller can include a processor and memory and the memory can include instructions that when executed by the processor cause the processor to control one or more of the detection circuit 220, the multiplexer 221, the crosstalk gain measure and store circuit 222, the microphone amplifier and equalization circuit 223 and the secondary bus switch circuit 224 to operate as discussed below. In certain examples, the switch and detection circuit 202 can include one or more power supplies 226, 227. For brevity, the crosstalk gain measure and store circuit 222 may be referred to as a crosstalk compensation circuit.

In certain examples, a first power supply 226 can receive supply power $V_{DD}$ and can provide operating power for one or more of the circuits of the switch and detection circuit 202. In certain examples, a second power supply 227 can provide a bias voltage (MIC BIAS) for the microphone of a headset (not shown). In certain examples, an external resistor (not shown) can be coupled between the output of the second power supply 227 and the conductor for the microphone bias terminal (INT_MIC) of the electronic device.

In certain examples, upon connection of an audio dongle or connection of an audio jack to a connected audio dongle, one of the accessory detection circuit 220, the secondary bus switch circuit 224, the I2C slave circuit and a switch controller 225, or other controller of the electronic device can detect the proper state of the secondary bus switch 230 for the microphone bias terminal (INT_MIC) and the electronic device ground terminal (AGND) to be coupled to the Sideband Use 1 (SBU1) and Sideband Use 2 (SBU2) terminals of the USB-C connector of the audio dongle. Upon proper detection, a controller can control the state of the secondary bus switch 230 of the secondary bus switch circuit 224 to couple one of the SBU1 or SBU2 terminals to the electronic device ground (AGND) and the other SBU1 or SBU2 terminal to the microphone bias terminal (INT_MIC) of the electronic device. In addition, in certain examples, the I2C slave circuit or the switch controller 225 can provide a control signal (GD1 or GD2) to activate a transistor to couple the proper terminal of the SBU1 or SBU2 terminals to a ground reference.

In certain examples, the accessory detection circuit 220 can monitor the connection of an audio device to the electronic device via the audio dongle. The actual detection of the audio device connection is beyond the scope of the present subject matter. Upon detecting a connection, the accessory detection circuit 220 can initiate a compensation mode and can control the isolation of the electronic device from the terminals of the audio dongle that can be used for audio communication via the multiplexer 221. In certain examples, the terminals of the audio dongle that can be used for audio communication can include, but are not limited to, the data lines or terminals (Dp, Dn) and one of the sideband use terminals (SBU1 or SBU2). In addition, the accessory detection circuit 220 can also be used to generate signals to assist in detecting and providing a properly shifted ground reference during a compensation mode such that crosstalk between the audio output channels and crosstalk between the audio output channels and the microphone can be reduced during normal operation. In some examples, the signals generated or applied to the audio output channels by the accessory detection circuit 220 can be current signals for use in detecting impedances associated with the headphone speakers or the microphone of the connected headset. In some examples, the signals generated by the accessory detection circuit 220 can be inaudible signals for detecting crosstalk and for adjusting resistor divider networks 231, 232 to reduce the detected crosstalk.

In certain examples, the crosstalk gain measure and store circuit 222 includes one or more resistor divider networks 231, 232 coupled to the audio output terminals (Dp, Dn) that are configured to couple to the audio dongle. The resistor divider networks 231, 232, either individually or together, when properly setup, assist in eliminating crosstalk by providing a remote ground level that is set to replicate the ground at the audio headset. Proper setup of the remote ground level can attenuate or eliminate the influence of parasitic resistances and impedances of the audio jack and dongle connections and circuitry. In addition to the one or more resistor divider networks 231, 232, the crosstalk gain measure and store circuit 222 can include a comparator circuit 233, resistor divider memory circuits 234, 235 and a plurality of switches 236, 237, 238, 239.

In certain examples, an output of the comparator circuit 233 can be used to set the one or more resistor divider networks 231, 232 until the inputs to the comparator circuit 233 are equal. In some examples, the comparison and setting of the resistor divider networks 231, 232 can include processing by a controller such as the switch controller 225, a controller of the crosstalk gain measure and store circuit 222 or some other controller. For example, the controller can receive an indication from the comparator circuit 233 of the comparison results and can then adjust the one or more resistor divider networks 231, 232 until the indication of the comparator results indicate the inputs of the comparator circuit 233 are substantially equal.

In certain examples, the plurality of switches 236, 237, 238, 239 can be used to couple different conductors to the different inputs of the comparator circuit and to couple the output of the comparator circuit to the proper resistor divider. For example, a first switch 236 can be used to couple one of the audio channels directly to an input of the comparator circuit 233. A second switch 237 can be used to couple one of the resistor divider networks 231, 232 to an input of the comparator circuit 233. A third switch 238 can couple the output of the comparator circuit 233 to the proper resistor divider network 231, 232 and/or resistor divider memory circuit 234, 235. A fourth switch 239 can be used to couple or isolate a microphone input (INT_MIC) with an input of the comparator. Once a resistor divider 231, 232 is adjusted, the setting for the resistor divider network 231, 232 can be saved in a resistor divider memory circuit 234, 235. Details of example methods for setting the resistor divider networks 231, 232 are discussed with reference to FIG. 3 below.

In certain examples, after a resistor divider network 231, 232 are set to reduce or eliminate audio crosstalk, the comparator circuit 233 of the crosstalk gain measure and store circuit 222 can be isolated from the microphone amplifier and equalization circuit 223, the output of the microphone amplifier and equalization circuit 223 can be coupled to the CODEC of the electronic device using a switch 242 and the microphone amplifier and equalization circuit 223 can use the level shifted grounds provided by the resistor dividers as an amplifier reference. In certain examples, upon completion of setting the resistor dividers, the multiplexer can couple the data terminals (Dp, Dn) of the audio dongle to either data terminals (D+, D−) of the electronic device or audio output terminals (LEFT, RIGHT) of the electronic device. In some examples, since an audio accessory was detected, the multiplexer couples the data terminals (Dp, Dn) of the audio dongle to audio output terminals (LEFT, RIGHT) of the electronic device. In certain examples, power for the microphone amplifier and equalization circuit 223 can be provided by the second power supply 227.

Figure 2B:
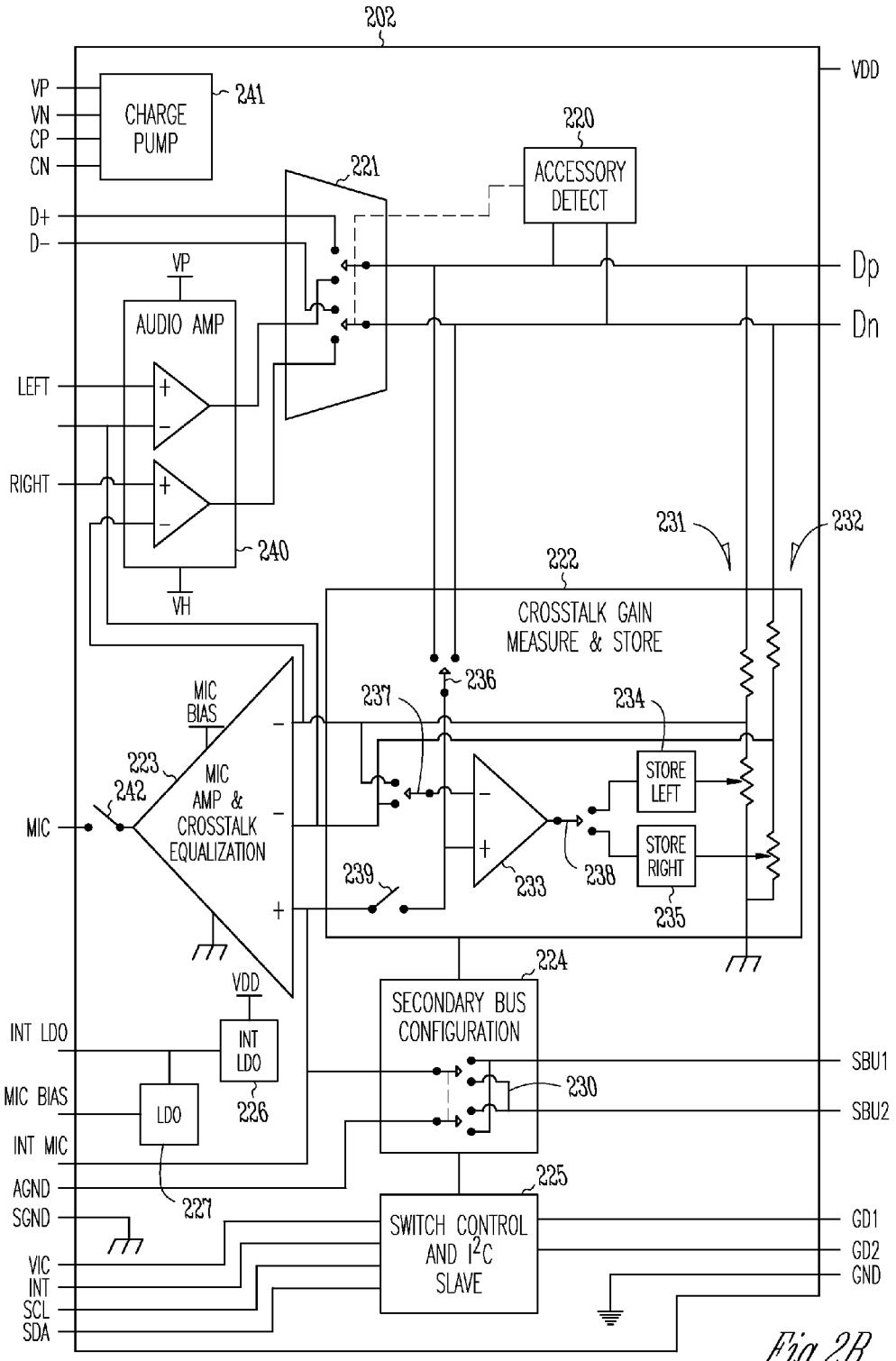
FIG. 2B illustrates generally an example detection circuit including audio amplifiers.

FIG. 2B illustrates generally an example switch and detection circuit 202 that can include an audio amplifier circuit 240 for amplifying the audio signals received from the CODEC of the electronic device. In some examples, the switch and detection circuit 202 that can include a power supply, such as a charge pump 241, to provide power for the audio amplifier circuit 240.

Figure 3:
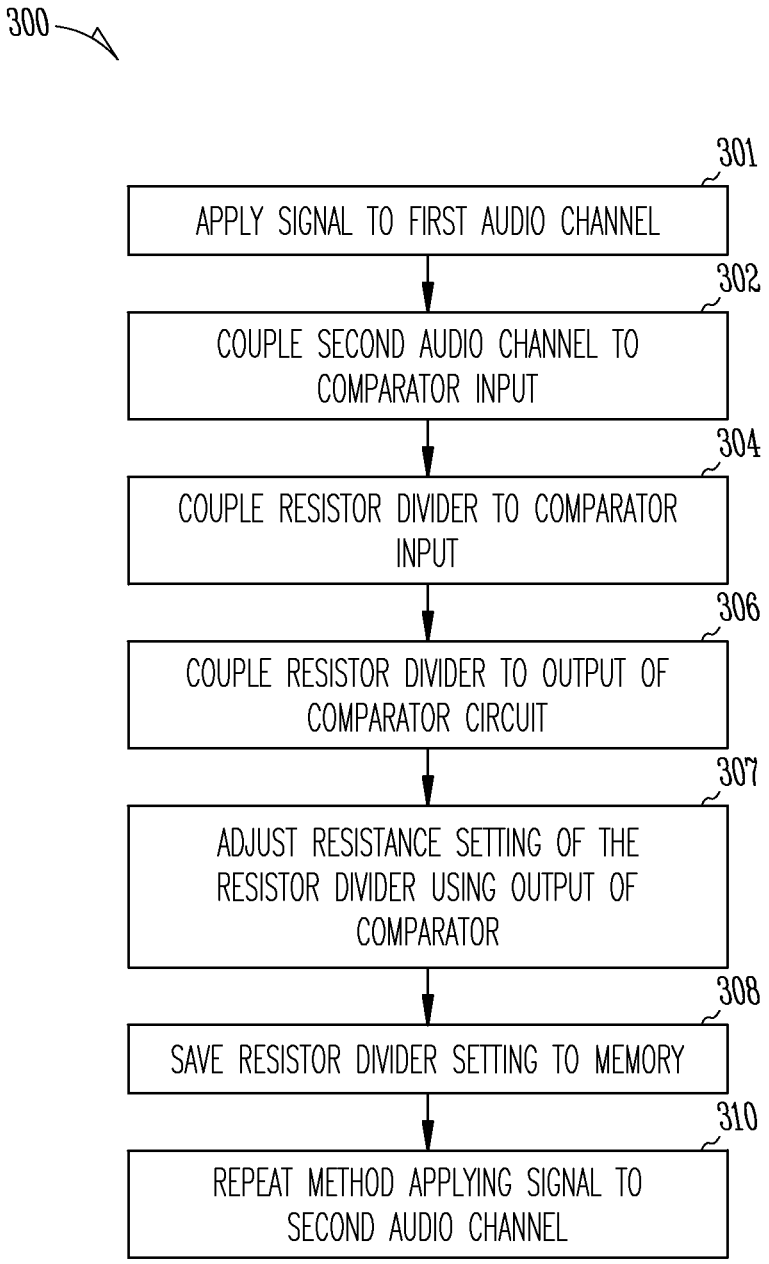
FIG. 3 illustrates generally a flowchart of an example method of setting resistor dividers to reduce crosstalk of headset microphone and audio signals coupled to an electronic device using an audio dongle.

FIG. 3 illustrates generally an example method 300 of setting resistor dividers to reduce crosstalk of headset microphone and audio signals coupled to an electronic device using an audio dongle such as an audio dongle including an audio jack connector and one or more USB-C connectors. At 301, a signal can be applied to a first audio output channel that is coupled to the headset via the audio dongle for example using the accessory detection circuit. At 302, a second audio channel can be coupled to a second input of a comparator circuit using a first switch of a crosstalk gain measure and store circuit. At 304, a first resistor divider coupled between the first audio channel and ground can be coupled to a second input of the comparator circuit using a second switch of the crosstalk gain measure and store circuit. At 306, the output of the comparator circuit can be coupled to a first resistor divider using a third switch of the crosstalk gain measure and store circuit. At 307, the output of the comparator circuit can be used to adjust a resistance of the first resistor divider until the first and second inputs of the comparator circuit are equal. At 308, the resistance setting of the first resistor divider can be saved to memory so the resistance setting does not change until a new connection of a headset is detected and new setting established. At 310, the method can be repeated with the second audio channel receiving the signal, the first audio channel sensing the crosstalk and a second resistor divider coupled between the second audio channel and ground being set using the output of the comparator circuit.

In certain examples, where the headset includes a microphone, upon setting either or both of the resistor dividers using the method above, the signal of the accessory detection circuit can continue to be applied to an audio channel, the other audio channel can be isolated from the second input of the comparator circuit using the first switch, and the microphone channel can be coupled to the second channel using a fourth switch, or a microphone switch, of the crosstalk gain measure and store circuit.

Upon exiting the method to set the resistor divider settings, the first switch, the second switch, and the fourth switch can be set to isolate their respective terminals from the crosstalk gain measure and store circuit. Also upon exiting the method to set the resistor divider settings, the accessory detection circuit can cease generating a signal on either audio channel and can use the multiplexer to couple the data terminals (Dp, Dn) of the audio dongle to either data terminals (D+, D−) of the electronic device or audio output terminals (LEFT, RIGHT) of the electronic device. In certain examples, a microphone amplifier and crosstalk equalizer can receive the microphone input signal and the level corrected ground signals from the resistor dividers. In certain examples, the level corrected ground signals can be received by audio amplifiers providing the output audio signals from the electronic device to the headset via the audio dongle.

Additional Notes and Examples

In Example 1, a method of operating a switch and detect circuit to reduce headset audio crosstalk can include applying a first signal to a first speaker channel of a headset, coupling a second speaker channel to a first input of a comparator of a crosstalk compensation circuit using a first switch of the crosstalk compensation circuit, the switch and detect circuit including the crosstalk compensation circuit, coupling a first resistor divider to a second input of the comparator using a second switch of the crosstalk compensation circuit, and adjusting a resistance setting of the first resistor divider from an initial setting using an output of the comparator.

In Example 2, the method of Example 1 optionally includes storing the resistance setting of the first resistor divider in a memory circuit of the crosstalk compensation circuit.

In Example 3, the first signal of any one or more of Examples 1-2 optionally is an inaudible signal.

In Example 4, the method of any one or more of Examples 1-3 optionally includes detecting connection of the headset to a Universal Serial Bus (USB) audio dongle prior to applying the first signal using a detection circuit of the switch and detect circuit.

In Example 5, the detecting connection of the headset to an (USB) audio dongle of any one or more of Examples 1-4 optionally includes coupling a microphone audio channel of the USB audio dongle to a microphone audio channel of an audio coder/decoder using a fourth switch of the switch and detect circuit.

In Example 6, the method of any one or more of Examples 1-5 optionally includes sensing a speaker impedance associated with the first speaker channel prior to applying the first signal and after the detecting connection of the headset.

In Example 7, the method of any one or more of Examples 1-6 optionally includes adjusting the resistance setting of the first resistor divider to the initial setting using the sensed speaker impedance.

In Example 8, the method of any one or more of Examples 1-7 optionally includes isolating the second input of the comparator from the first resistor divider after adjusting the resistance setting of the first resistor divider, and coupling a microphone input of the headset to the second input of the comparator using a third switch of the crosstalk compensation circuit.

In Example 9, the method of any one or more of Examples 1-8 optionally includes adjusting a resistance setting of the first resistor divider a second time to compensate for crosstalk noise on the microphone input.

In Example 10, the method of any one or more of Examples 1-9 optionally includes storing the resistance setting of the first resistor divider in a memory circuit of the crosstalk compensation circuit.

In Example 11, the method of any one or more of Examples 1-10 optionally includes applying a second signal to the second speaker channel of the headset, coupling the first speaker channel to a first input of the comparator using the first switch, coupling a second resistor divider to the second input of the comparator using the second switch, and adjusting a resistance setting of the second resistor divider from an initial setting using the output of the comparator.

In Example 12, a switch and detect circuit configured to couple an electronic device with an audio dongle can include a multiplexer circuit configured to couple first and second data lines of the audio dongle with first and second data lines of the electronic device or first and second audio channels of the electronic device, a detect circuit configured to couple to the first and second data lines of an audio dongle, to control the multiplexer and to apply a first signal to a first speaker channel of a headset using the first data line of the dongle during a first crosstalk compensation mode, a comparator circuit, a first resistor divider configured to couple to the first data line, a first memory circuit configured to set a resistance of the resistor divider to a first setting and to store the first setting, a first switch configured to couple the second data line to a first input of the comparator during the first crosstalk compensation mode, a second switch configured to couple the first resistor divider to a second input of the comparator during the first crosstalk compensation mode, a third switch configured to couple an output of the comparator to the first memory circuit during the first crosstalk compensation mode, and wherein the comparator circuit is configured to compare the first input with the second input during the first crosstalk compensation mode and to adjust the first setting until the first input and the second input are equal.

In Example 13, the first signal of any one or more of Examples 1-11 optionally is an inaudible signal.

In Example 14, the circuit of any one or more of Examples 1-13 optionally includes a second resistor divider coupled to the second data line, a second memory circuit configured to set a resistance of the resistor divider to a second setting and to store the second setting, wherein the detect circuit is configured to apply a second signal to a second speaker channel of the headset using the second data line during a second crosstalk compensation mode, wherein the first switch is configured to couple the first data line to the first input of the comparator during the second crosstalk compensation mode, wherein the second switch is configured to couple the second resistor divider to the second input of the comparator during the second crosstalk compensation mode, wherein the third switch is configured to couple the output of the comparator to the second memory circuit during the second crosstalk compensation mode, and wherein the comparator circuit is configured to compare the first input with the second input during the second crosstalk compensation mode and to adjust the second setting until the first input and the second input are equal.

In Example 15, the second signal of any one or more of Examples 1-14 optionally is an inaudible signal.

In Example 16, the circuit of any one or more of Examples 1-15 optionally includes a fourth switch configured to couple one of two possible ground conductors of the audio dongle with a ground terminal of the electronic device.

In Example 17, the fourth switch of any one or more of Examples 1-16 optionally is configured to couple the other of the two possible ground conductors with a microphone terminal of the electronic device.

In Example 18, the circuit of any one or more of Examples 1-17 optionally includes a microphone conductor configured to receive a microphone signal from a headset coupled to the audio dongle, and a fifth switch configured to couple the microphone conductor to the second input of the comparator during at least a portion of the first crosstalk compensation mode.

In Example 19, the second switch of any one or more of Examples 1-18 optionally is configured to isolate the second data line from the second input of the comparator during the at least portion of the first crosstalk compensation mode.

In Example 20, the circuit of any one or more of Examples 1-19 optionally includes a microphone amplifier coupled to the first resistor divider, the microphone amplifier configured to amplify a microphone signal received from a headset coupled to the audio dongle to provide an amplified microphone signal to the electronic device and to attenuate speaker signal crosstalk within the amplified microphone signal using the first resistor divider.

In Example 21, the microphone amplifier of any one or more of Examples 1-20 optionally is configured to attenuate speaker signal crosstalk within the amplified microphone signal using the first resistor divider and second resistor divider.

In Example 22, the circuit of any one or more of Examples 1-21 optionally includes a Universal Serial Bus (USB) connector configured to couple the detect circuit with the audio dongle.

Example 23 can include, or can optionally be combined with any portion or combination of any portions of any one or more of Examples 1 through 22 to include, subject matter that can include means for performing any one or more of the functions of Examples 1 through 22, or a machine-readable medium including instructions that, when performed by a machine, cause the machine to perform any one or more of the functions of Examples 1 through 22.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, the code can be tangibly stored on one or more volatile or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A method of operating a switch and detect circuit to reduce headset audio crosstalk, the method comprising:

applying a first signal to an output terminal of a first audio channel, the output terminal of the first audio channel being configured to be coupled to an input terminal of a first speaker channel of a headset;

coupling an output terminal of a second audio channel configured to be coupled to an input terminal of a second speaker channel of the headset to a first input of a comparator of a crosstalk compensation circuit using a first switch of the crosstalk compensation circuit, the switch and detect circuit including the crosstalk compensation circuit;

coupling a first resistor divider to a second input of the comparator using a second switch of the crosstalk compensation circuit; and adjusting a resistance setting of the first resistor divider from an initial setting using an output of the comparator.

2. The method of claim 1, including storing the resistance setting of the first resistor divider in a memory circuit of the crosstalk compensation circuit.

3. The method of claim 1, wherein the first signal is an inaudible signal.

4. The method of claim 1, including detecting connection of the headset to a Universal Serial Bus (USB) audio dongle prior to applying the first signal using a detection circuit of the switch and detect circuit.

5. The method of claim 4, wherein the detecting connection of the headset to the USB audio dongle includes coupling a microphone audio channel of the USB audio dongle to a microphone audio channel of an audio coder/decoder using a third switch of the switch and detect circuit.

6. The method of claim 4, including sensing a speaker impedance associated with the first speaker channel prior to applying the first signal and after the detecting connection of the headset.

7. The method of claim 6, including adjusting the resistance setting of the first resistor divider to the initial setting using the sensed speaker impedance.

8. The method of claim 1, including isolating the second input of the comparator from the first resistor divider after adjusting the resistance setting of the first resistor divider; and coupling a microphone input of the headset to the second input of the comparator using a third switch of the crosstalk compensation circuit.

9. The method of claim 8, including adjusting the resistance setting of the first resistor divider a second time to compensate for crosstalk noise on the microphone input.

10. The method of claim 9, including storing the resistance setting of the first resistor divider in a memory circuit of the crosstalk compensation circuit.

11. The method of claim 1, including applying a second signal to the second speaker channel of the headset;

coupling the first speaker channel to a first input of the comparator using the first switch;

coupling a second resistor divider to the second input of the comparator using the second switch; and adjusting a resistance setting of the second resistor divider from an initial setting using the output of the comparator.

12. A switch and detect circuit configured to couple an electronic device with an audio dongle, the switch and detect circuit comprising:

a multiplexer circuit configured to couple first and second data lines of the audio dongle with first and second data lines of the electronic device or first and second audio channels of the electronic device;

a detect circuit configured to couple to the first and second data lines of an audio dongle, to control the multiplexer circuit and to apply a first signal to a first speaker channel of a headset using the first data line of the audio dongle during a first crosstalk compensation mode;

a comparator circuit;

a first resistor divider configured to couple to the first data line;

a first memory circuit configured to set a resistance of the first resistor divider to a first setting and to store the first setting;

a first switch configured to couple the second data line to a first input of the comparator during the first crosstalk compensation mode;

a second switch configured to couple the first resistor divider to a second input of the comparator during the first crosstalk compensation mode; and a third switch configured to couple an output of the comparator to the first memory circuit during the first crosstalk compensation mode, wherein the comparator circuit is configured to compare the first input with the second input during the first crosstalk compensation mode and to adjust the first setting until the first input and the second input are equal.

13. The switch and detect circuit of claim 12, wherein the first signal is an inaudible signal.

14. The switch and detect circuit of claim 12, including:

a second resistor divider coupled to the second data line; and a second memory circuit configured to set a resistance of the resistor divider to a second setting and to store the second setting, wherein the detect circuit is configured to apply a second signal to a second speaker channel of the headset using the second data line during a second crosstalk compensation mode, wherein the first switch is configured to couple the first data line to the first input of the comparator during the second crosstalk compensation mode, wherein the second switch is configured to couple the second resistor divider to the second input of the comparator during the second crosstalk compensation mode, wherein the third switch is configured to couple the output of the comparator to the second memory circuit during the second crosstalk compensation mode, and wherein the comparator circuit is configured to compare the first input with the second input during the second crosstalk compensation mode and to adjust the second setting until the first input and the second input are equal.

15. The switch and detect circuit of claim 14, wherein the second signal is an inaudible signal.

16. The switch and detect circuit of claim 12, including a fourth switch configured to couple one of two possible ground conductors of the audio dongle with a ground terminal of the electronic device.

17. The switch and detect circuit of claim 16, wherein the fourth switch is configured to couple the one of two possible ground conductors with a microphone terminal of the electronic device.

18. The switch and detect circuit of claim 12, including a microphone conductor configured to receive a microphone signal from a headset coupled to the audio dongle; and a fifth switch configured to couple the microphone conductor to the second input of the comparator during at least a portion of the first crosstalk compensation mode.

19. The switch and detect circuit of claim 18, wherein the second switch is configured to isolate the second data line from the second input of the comparator during the at least a portion of the first crosstalk compensation mode.

20. The switch and detect circuit of claim 12, including a microphone amplifier coupled to the first resistor divider, the microphone amplifier configured to amplify a microphone signal received from a headset coupled to the audio dongle to provide an amplified microphone signal to the electronic device and to attenuate speaker signal crosstalk within the amplified microphone signal using the first resistor divider.

21. The switch and detect circuit of claim 20, wherein the microphone amplifier is configured to attenuate speaker signal crosstalk within the amplified microphone signal using the first resistor divider and a second resistor divider.

22. The switch and detect circuit of claim 12, including a Universal Serial Bus (USB) connector configured to couple the detect circuit with the audio dongle.

* * * * *